US006195517B1

(12) United States Patent
Park et al.

(10) Patent No.: US 6,195,517 B1
(45) Date of Patent: Feb. 27, 2001

(54) APPARATUS AND METHOD OF REMOVING PHOTORECEPTOR BELT FOR ELECTROPHOTOGRAPHIC PRINTER

(75) Inventors: Woo-yong Park, Suwon; Won-hyung Lee, Seoul; Kwang-ho No, Suwon, all of (KR)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/472,957

(22) Filed: Dec. 27, 1999

(30) Foreign Application Priority Data

Jul. 28, 1999 (KR) ..... 99-30827

(51) Int. Cl.[7] ..... G03G 15/00
(52) U.S. Cl. ..... 399/116; 399/161
(58) Field of Search ..... 399/116, 161

(56) References Cited

U.S. PATENT DOCUMENTS 4,215,932 * 8/1980 Castelli et al. ..... 399/161

* cited by examiner

*Primary Examiner*—Quana M. Grainger
(74) *Attorney, Agent, or Firm*—Robert E. Bushnell, Esq.

(57) ABSTRACT

An apparatus and a method of removing a photoreceptor belt from an electrophotographic printer are provided. The apparatus includes at least one pair of rollers for pressing and transferring the photoreceptor belt circulating in a predetermined traveling track, a cutting blade capable of cutting the photoreceptor belt while moving across the photoreceptor belt, a cylindrical member rotatably installed in a filter housing disposed near the photoreceptor belt, the filter housing having a filter cartridge for filtering foreign material of the inner air of the printer, and a driver for rotating the cylindrical member such that the photoreceptor belt is wound around the cylindrical member. The photoreceptor belt is cut and automatically drawn from the traveling track into the filter housing. The cut photoreceptor belt is removed together with the filter cartridge installed in the filter housing. The photoreceptor belt removing process can be easily and quickly performed, and it is also convenient to manage a replacement cycle of supplies for a printer.

21 Claims, 6 Drawing Sheets

APPARATUS AND METHOD OF REMOVING PHOTORECEPTOR BELT FOR ELECTROPHOTOGRAPHIC PRINTER

CLAIM OF PRIORITY

This application makes reference to, incorporates the same herein, and claims all benefits accruing under 35 U.S.C. §119 from my application APPARATUS OF REMOVING PHOTORECEPTOR BELT FOR ELECTROPHOTOGRAPHIC PRINTER AND METHOD OF REMOVING PHOTORECEPTOR BELT USING THE SAME filed with the Korean Industrial Property Office on Jul. 28, 1999 and there duly assigned Serial No. 30827/1999.

BACKGROUND OF THE INVENTION

1. Field of the Invention

The present invention relates to an apparatus and a method for removing a photoreceptor belt from a printer, more particularly, for cutting the photoreceptor belt by using a cutting blade and automatically removing the photoreceptor belt from the printer in order to replace the photoreceptor belt with a new one.

2. Description of the Related Art

A photoreceptor belt has been used for printing an image on a recordable medium in an electrophotographic printer such as a color laser printer. The image is developed on one side of the photoreceptor belt by a development unit, and then the developed image formed on the photoreceptor belt is transferred to a transfer roller located between the photoreceptor belt and a recordable medium and then printed on the recordable medium such as a sheet of paper.

The photoreceptor belt, however, becomes deteriorated by repeated uses. The degree of accuracy of an image developed thereon is gradually lowered. The longer period of time the photoreceptor belt is used in the printer, the less accurate the developed image on the photoreceptor belt and the less clear the printed image on the recordable medium. Thus, in order to obtain an accurate developed image on the photoreceptor belt and a clear printed image on the printable medium, the photodetector belt should be removed from a belt unit and replaced with a new one after it has been used for a predetermined life time.

In a conventional method, a worn photoreceptorbelt is manually extracted from the belt unit. Manual drawing of the photoreceptor belt from the belt unit, however, is a complicated and time consuming process. Since a manual operation of drawing of the photoreceptor belt from the belt unit is performed in a narrow space where parts of the printer are assembled in a confined space, the hands of an operator may be injured by the parts.

In addition to the photoreceptor belt, a filter cartridge has been used for filtering the inner air within the printer by using a pump for sucking the inner air through the filtering cartridge so that harmful materials contained in the inner air are filtered by the filter cartridge before the inner air is exhausted to the outside of the printer. Since harmful materials contained in the inner air affect on the developed image formed on the photoreceptor belt and prevent the printed image from being clear, the inner air containing the harmful materials should be filtered by the filter cartridge and the filter cartridge should be replaced in order to obtain a clear printed image. Although the replacement cycle of the filter cartridge and the photoreceptor belt may be the same each other, the filter cartridge and the photoreceptor belt are separately removed from the printer and replaced by a new one respectively, thereby the replacement processes are complicated and bothersome. In order to keep an effective filtering performance and avoid the harmful affect on the developed and printed images, it is preferable that the filter cartridge and the photoreceptor belt are simultaneously replaced periodically.

SUMMARY OF THE INVENTION

It is an object of the present invention to provide an apparatus and a method of removing a photoreceptor belt from a printer.

It is another object to provide an apparatus and a method able to automatically cutting a photoreceptor belt in order to remove the photoreceptor belt from the printer.

It is yet another object to provide an apparatus and a method able to automatically draw a photoreceptor belt from the belt unit into a filter housing installed in a printer.

It is still another object to provide an apparatus and a method able to remove a photoreceptor belt and a filter cartridge from a printer at the same time.

It is a further object to provide an apparatus and a method able to protect a user from being injured during manually removing a photoreceptor belt from the printer.

It is also an object to provide an apparatus and a method able to automatically, easily and quickly removing the photoreceptor belt from the printer.

It is also object to provide an apparatus and a method able to obtain an accurate developed image formed on the photoreceptor belt and a clear image printed on a recordable medium.

These and other objects may be achieved by providing an apparatus including a belt unit having a photoreceptor belt circulating and traveling in a predetermined track within a belt unit of a printer, a belt cutting unit disposed adjacent to the belt unit and having a cutting blade moving in a transverse direction of the given predetermined track and cutting photoreceptor belt while passing through the photoreceptor belt, a filter housing disposed adjacent to the given track of the belt unit, a filter cartridge fixed to the filter housing and disposed to filter foreign materials contained in the inner air within the printer, a cylindrical member rotatably disposed on the filter housing to withdraw the photoreceptor belt cut by the cutting blade from the belt unit into the filter housing, a gap provided between the filter housing and the cylindrical member and accommodating the photoreceptor belt after the photoreceptor belt has been cut by the cutting blade, a motor unit disposed adjacent to the cylindrical member to rotate the cylindrical member.

The rollers disposed in the belt unit rotate in a reverse direction of the circulation of the photoreceptor belt to feed the photoreceptor belt between the cylindrical member and a pressure roller rotatably contacting the cylindrical member after the photoreceptor belt has been cut by the cutting blade of the cutting unit. The photoreceptor belt fed between the cylindrical member and a pressure roller is introduced into the gap between the cylindrical member and the filter housing.

A photoreceptor belt of an electrophotographic printer is removed from the belt unit by a method including the steps of setting at least one pair of rollers for pressing and transferring the photoreceptor belt in a predetermined track within the belt unit, providing a cutting blade capable of cutting the photoreceptor belt while moving in traverse direction of the track and passing through the photoreceptor belt, a filter housing disposed adjacent to photoreceptor belt of the belt unit, a cylindrical member rotatably installed in the filter housing, a filter cartridge fixed to the filter housing and disposed inside of the cylindrical member to filter foreign material of the inner air of the printer, and a driving unit rotating the cylindrical member such that the photoreceptor belt is wound around the cylindrical member, driving the cutting blade to cut the photoreceptor belt, rotating the pair of rollers to draw the cut photoreceptor belt into the filter housing, rotating the cylindrical member by the driving unit such that the photoreceptor belt fed into the filtering housing is wound around the cylindrical member, and detaching the filtering housing from the printer.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
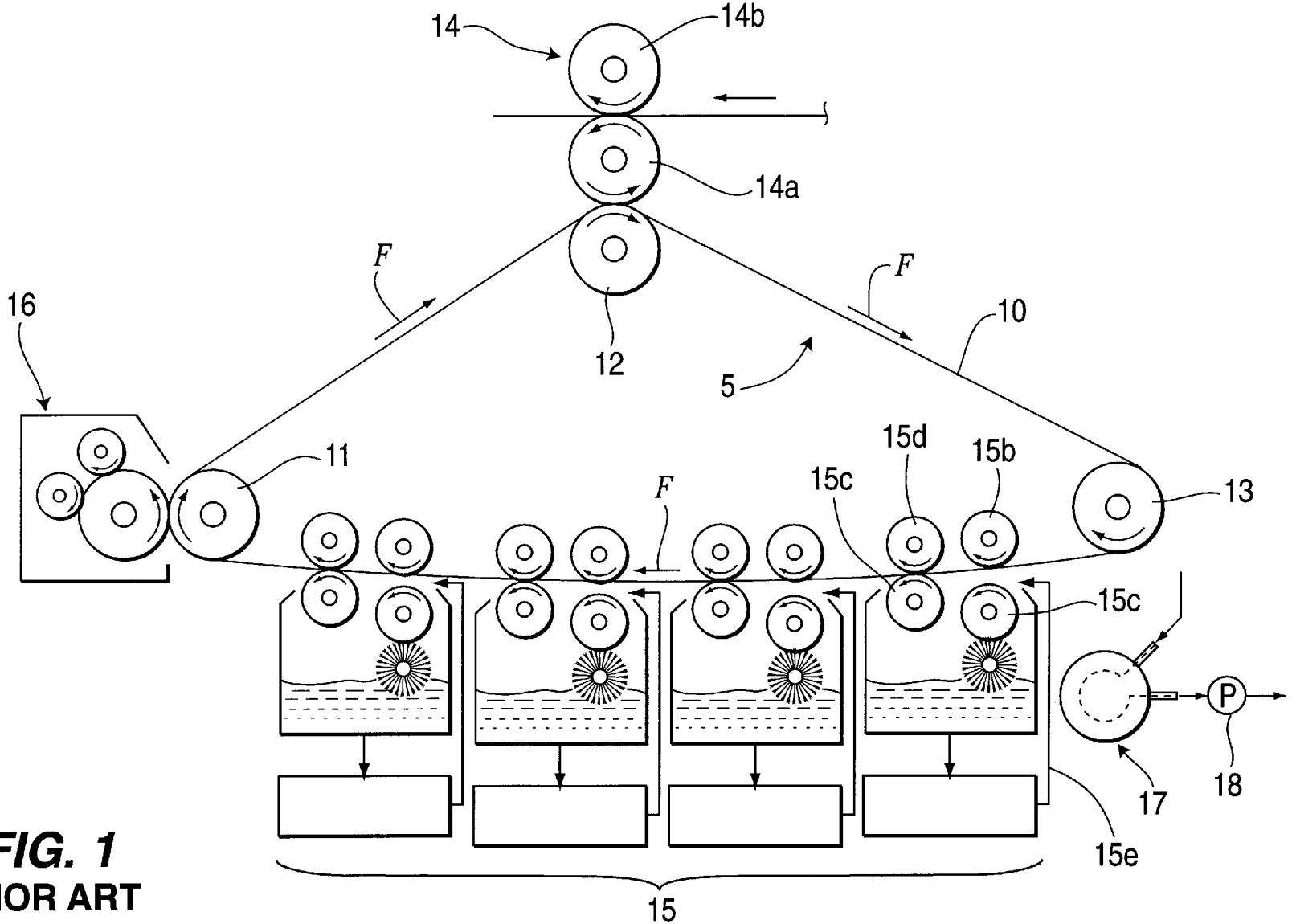
FIG. 1 PRIOR ART
FIG. 1 is a schematic diagram of major elements of a general electrophotographic printer.

Referring to FIG. 1, an electrophotographic printer such as a color laser printer includes a photoreceptor belt 10 which circulates along a given track formed by a plurality of rollers 11, 12 and 13 each disposed to feed the photoreceptor belt in the direction of an arrow F in the main body of the printer. An image is developed on one side of the photoreceptor belt 10 by a development unit 15. The developed image formed on the photoreceptor belt 10 is dried when the photoreceptor belt 10 is passing through a drying unit 16. Transfer unit 14 includes a transfer roller 14*a* and a fuser roller 14*b*. The developed image on the photoreceptor belt 10 is transferred to the transfer roller 14*a*, and then the transferred image of the transfer roller 14*a* is printed on the sheet of paper 1.

A belt unit 5 including rollers 11, 12, 13 allows the photoreceptor belt 10 to circulate along the given track passing through development unit 15, drying unit 16, and transfer unit 14. Development unit 15 includes a developing roller 15*a* for developing an electrostatic latent image on the photoreceptor belt 10 by using a developer supplied from a predetermined developer supplying portion 15*e*, a developing backup roller 15*b*, and a squeegee roller 15*c* and a squeegee backup roller 15*d* squeezing the photoreceptor belt 10 to remove an excess amount of developer from the image developed by the developer roller 15*a*. A filter cartridge 17 is disposed to filter the inner air within the printer. A sucking pump 18 sucks the inner air through filtering cartridge 17 such that harmful materials contained in the inner air are filtered by filter cartridge 17 before the inner air is exhausted to the outside.

Figure 2:
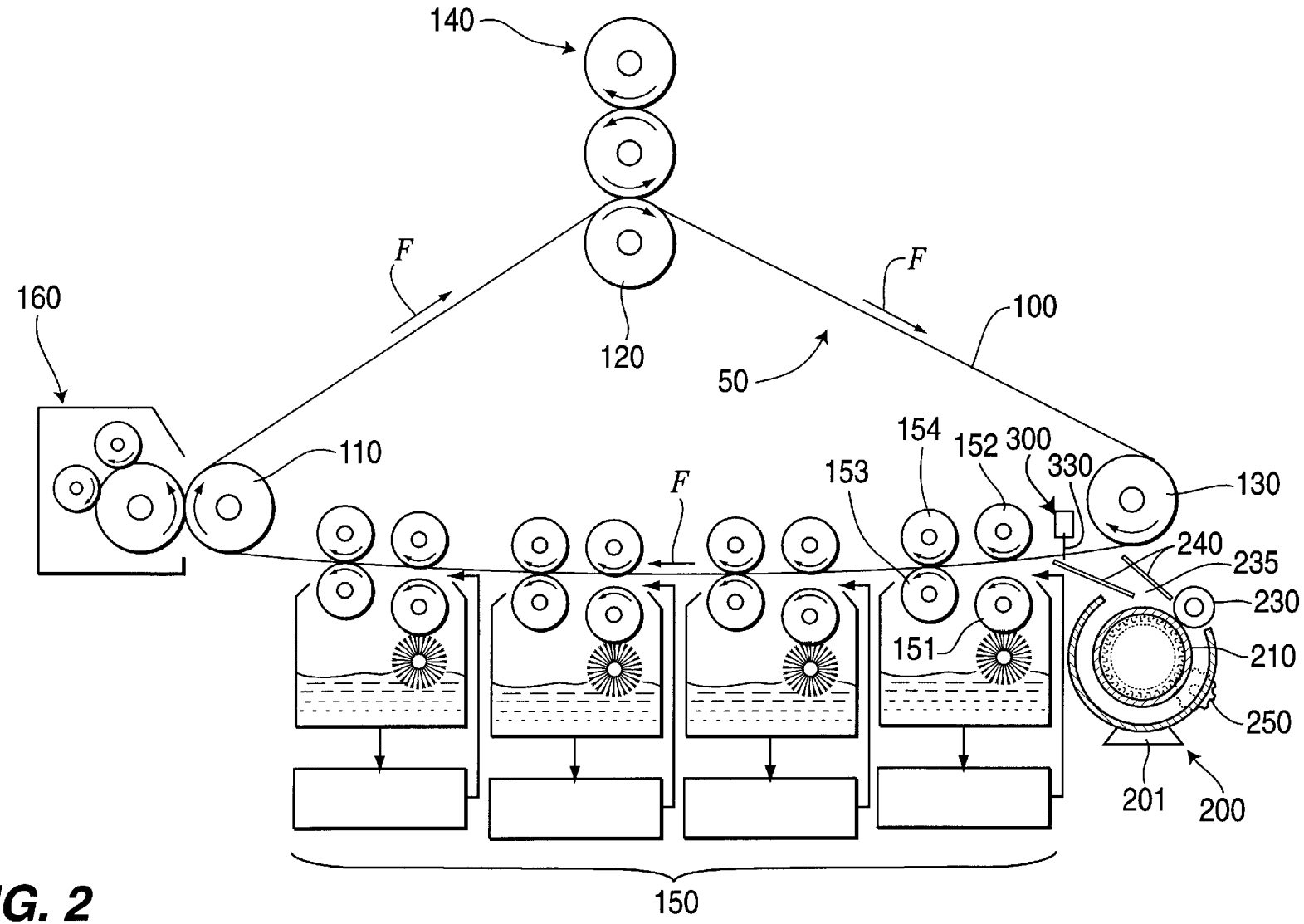
FIG. 2 is a schematic diagram showing a photoreceptor belt removing apparatus of an electrophotographic printer according to the principle of the present invention.

In FIG. 2, a photoreceptor belt 100 is installed on the belt unit 50 including a plurality of rollers 110, 120 and 130 such that the photoreceptor belt 100 circulates in the direction of an arrow F along a given traveling track. A development unit 150, a drying unit 160 and a transfer unit 140 are disposed on the traveling track of the photoreceptor belt 100. Development unit 150 includes a developing roller 151 developing an image on one surface of the photosensitive photoreceptor belt 100, a developing backup roller 152, and a squeegee roller 153 and a squeegee backup roller 154 squeezing the photoreceptor belt 100 to remove an excessive developer from the developed image. The squeegee roller 153 and the squeegee backup roller 154 also feed the photoreceptor belt 100 into a filter housing 200 after photoreceptor belt 100 has been cut by a belt cutting unit 300, thereby removing the photoreceptor belt 100 from belt unit 50. Belt cutting unit 300 is disposed over a portion of belt unit 50 to cut the photoreceptor belt 100. A cylindrical member 210 is rotatably installed in filter housing 200 in order to wind photoreceptor belt 100 cut by belt cutting unit 300 around outer surface of cylindrical member 210 and transferred to an opening 235 formed on an open end portion 200*a* of filter housing 200 by squeegee roller 153 and squeegee backup roller 154 disposed in development unit 150.

Figure 3:
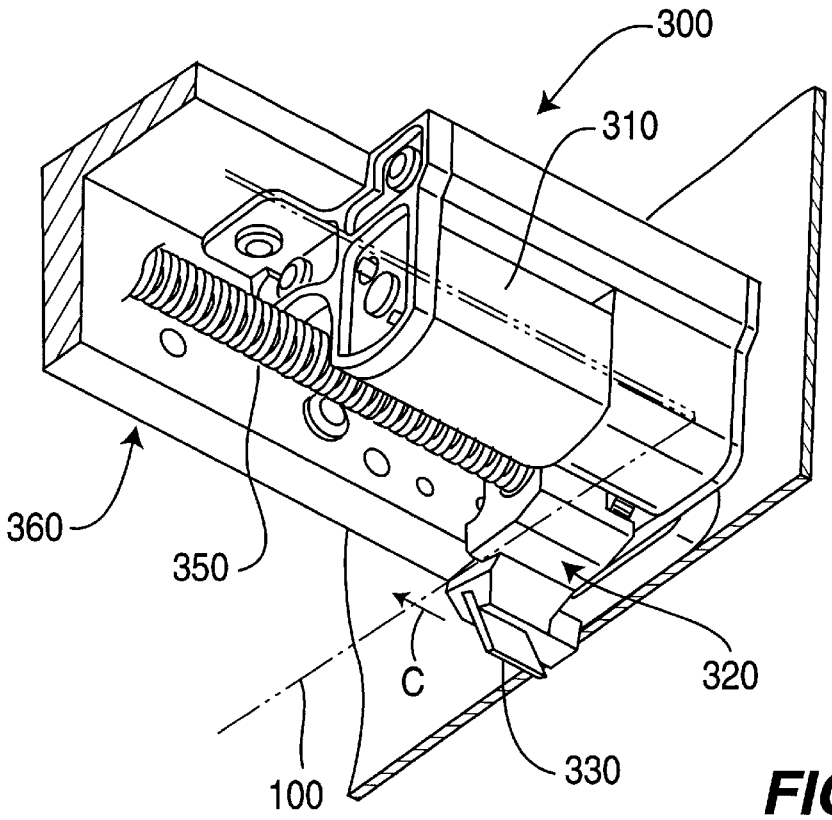
FIGS. 3 and 4 are perspective views showing a belt cutting unit of the photoreceptor belt removing apparatus shown in FIG. 2.
Figure 4:
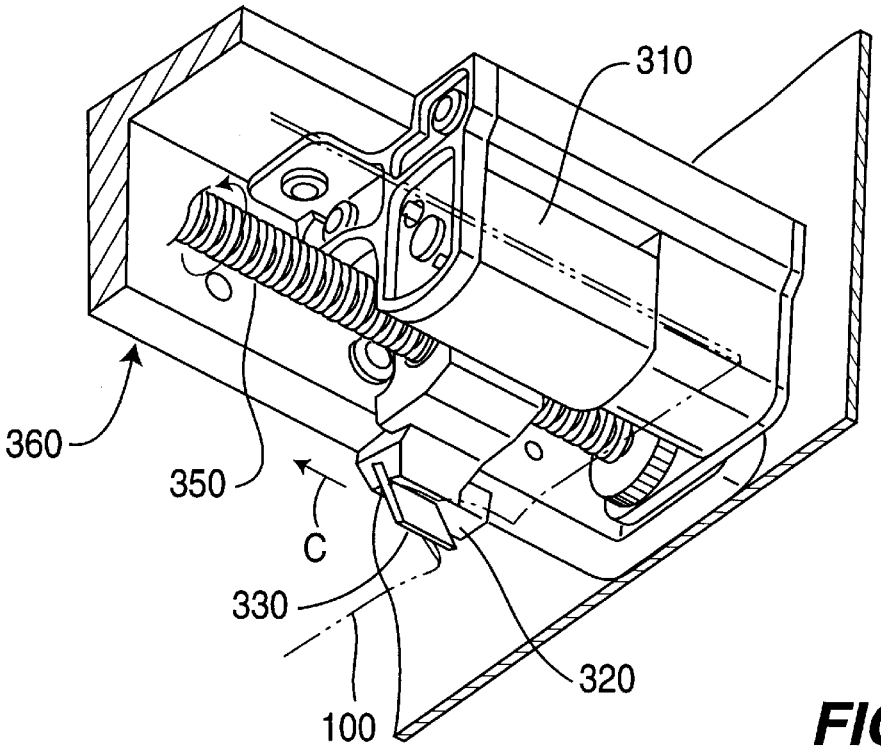

As shown in FIGS. 3 and 4, belt cutting unit 300 includes a driving motor 310, a lead screw 350 rotatably mounted on belt cutting unit 300, connected to driving motor 310, and disposed to rotate by driving motor 310, a moving block 320 connected to the lead screw 350 and disposed to move forwards and backwards along an axis of lead screw 350 while lead screw 350 rotates, and a cutting blade 330 mounted on moving block 320 and disposed to cut photoreceptor belt 100 while moving across photoreceptor belt 100 in the direction of an arrow C. Reference numeral 360 represents a sliding support portion 360 supporting and guiding moving block 320 to slidably move forwards and backwards. As lead screw 350 rotates with the operation of the driving motor 310, moving block 320 moves across photoreceptor belt 100. At this time, cutting blade 330 mounted on moving block 320 cuts the photoreceptor belt 100 as shown in FIG. 4 while moving in the direction of an arrow C and passing through the photoreceptor belt 100.

Figure 5:
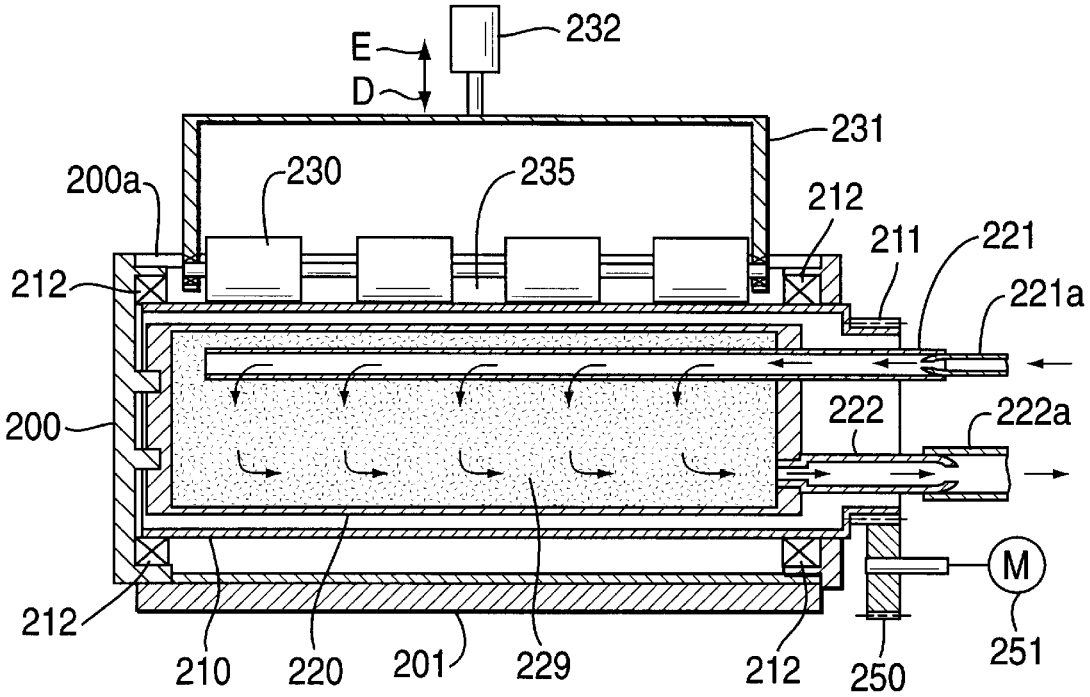
FIGS. 5 and 6 are a cross sectional view and a perspective view respectively illustrating a filter housing unit of the photoreceptor belt removing apparatus shown in FIG. 2.
Figure 6:
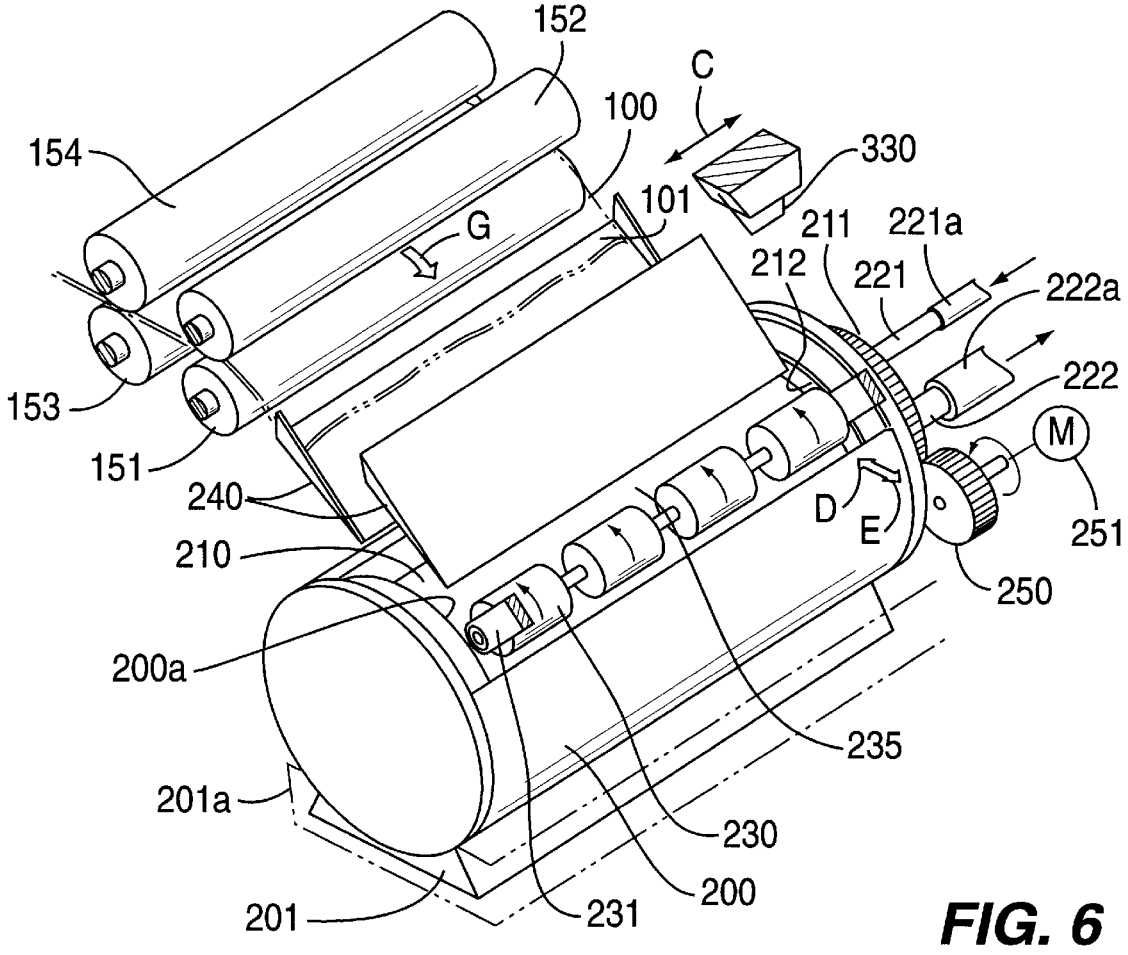
Figure 7:
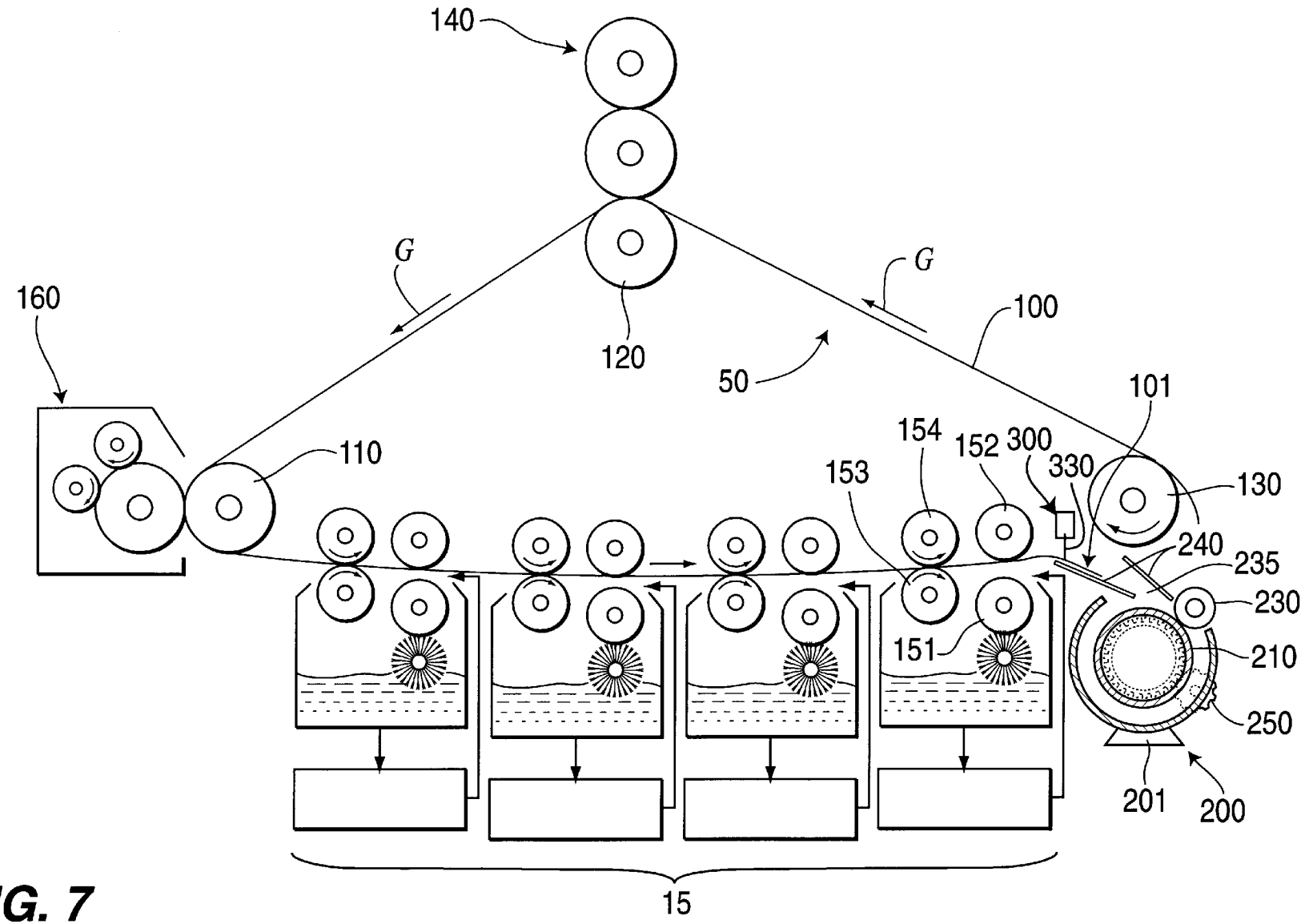
FIGS. 7 and 8 are schematic diagrams illustrating a photoreceptor belt removing process by the photoreceptor belt removing apparatus shown in FIG. 2.

Referring to FIGS. 5 and 6, a cylindrical member 210 having a hollow body and two openings formed on its end is rotatably supported by a plurality of bearings 212 within a filtering housing 200. A gear portion 211 is formed on an outer surface of the one end of cylindrical member 210 and engaged with a driving gear 250. A motor 251 is coupled to driving gear 250. Cylindrical member 210 rotates by motor 251 and driving gear 250. Thus, cylindrical member 210 rotates as the driving gear 250 rotates by motor 250. A filter cartridge 220 for filtering the inner air in the printer is disposed in inside of the hollow body of cylindrical member 210. One end of filter cartridge 220 is fixed to filter housing 200. Inside of filter cartridge is filled with a filtering material 229. Cylindrical member 210 supported by bearings 212 rotates within filter housing 200 while filter cartridge 220 located in inside of cylindrical member 210 is fixed to filtering housing 200. An inlet and an outlet formed on the other end of filter cartridge 220 pass through one end of cylindrical member 210. The inner air is introduced into filter cartridge 220 through inlet tube 211, filtered out through outlet tube 212. An air sucking tube 221 a and an air exhausting tube 222*a* are fitted to inlet tube 221 and outlet tube 222, respectively. The inner air flows into the filter cartridge 220 through the air sucking tube 221 a and the inlet tube 221, and is filtered passing through the filtering material located in inside of filter cartridge 220. The filtered air is expelled through the outlet tube 222 and the air exhausting tube 222*a*.

A pressure roller 230 is disposed through opening 235 defined by open end portion 200*a* of s filter housing 200 to contact an outer cylindrical surface of cylindrical member 210. Pressure roller 230 rotates with the rotation of cylindrical member 210 because pressure roller 230 is pushed against outer cylindrical surface of cylindrical member 210. Pressure roller 230 rotatably supported by a moving arm 231 and a lever 232 contacts cylindrical member 210 through opening 235 when moving arm moves in the direction of an arrow D or is separated from cylindrical member 210 through opening 235 when moving arm 231 moves in the direction indicated by an arrow E. When filter housing 200 is extracted from or inserted into the printer, pressure roller 230 is separated from cylindrical member 210 by moving arm 231 and lever 232. After filter housing 220 has been inserted into the printer, pressure roller 220 is pushed against cylindrical member 210.

Guide members 240 are disposed to guide a leading end 101 of photoreceptor belt 100 cut by cutting blade 330 into filter housing 200 and between cylindrical member 210 and pressure roller 230. A binding rail 201 attached to filter housing 200 is slidably coupled with a rail 201*a* of the printer.

In the operation of the photoreceptor belt removing apparatus having the above configuration, belt cutting unit 300 performs the cutting operation such that cutting blade 330 cuts a portion of photoreceptor belt 100 by moving in a transverse direction C of the circulating direction F of photoreceptor belt 100 circulating around rollers 110, 120, and 130. At this time, squeegee roller 153 and squeegee backup roller 154 squeeze the photoreceptor belt 100 so that photoreceptor belt 100 does not deviate from the given track after being cut and that leading cut end 101 of photoreceptor belt 100 cut by the blade 230 is placed on between guide members 240.

Figure 8:
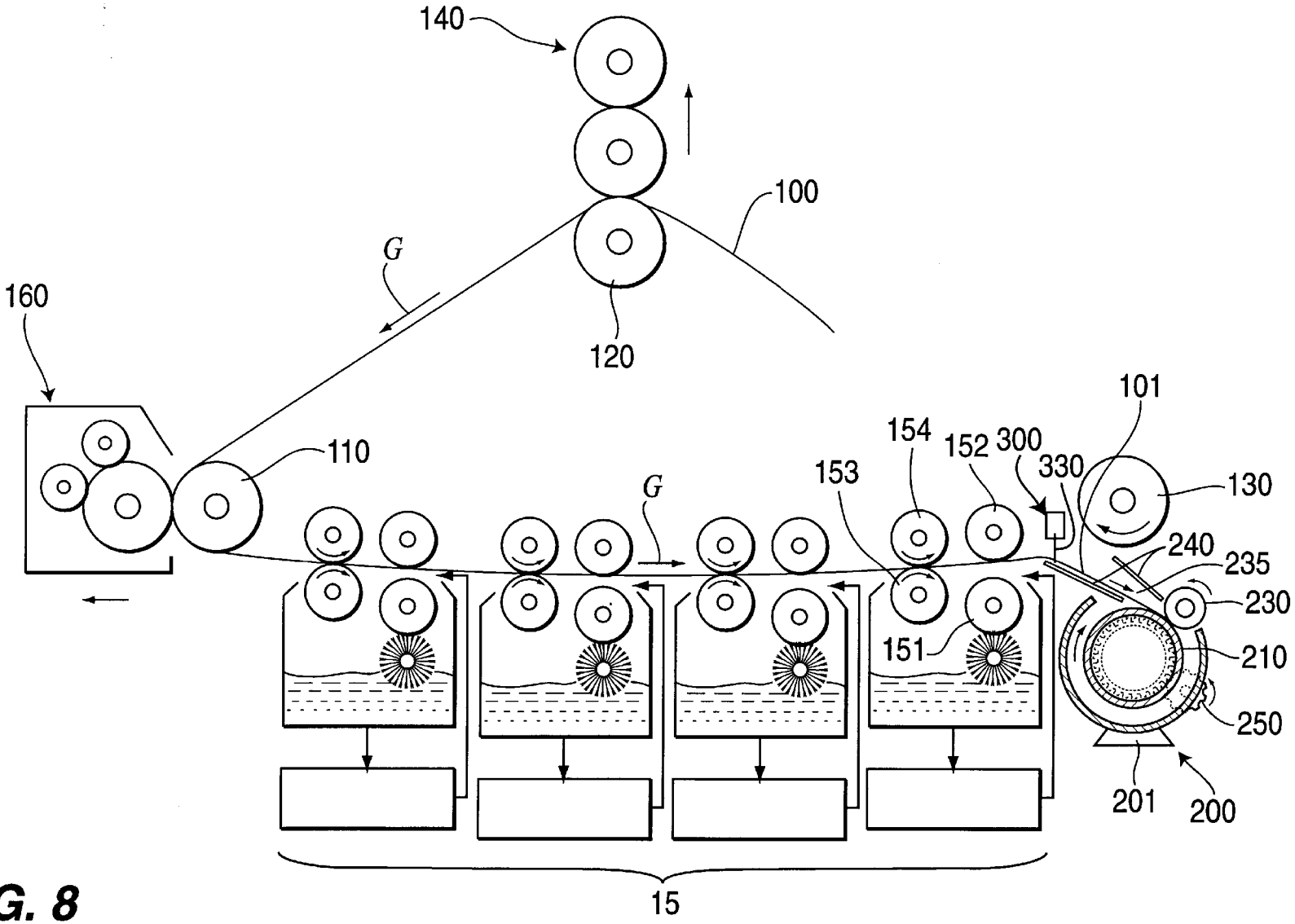

As shown in FIG. 8, squeegee roller 153 rotates in an opposite direction G to a printing direction F of a development process so that leading cut end 101 of photoreceptor belt 100 is guided into opening 235 of open end portion 200*a* of filter housing 200 by guide members 240. Simultaneously, driving gear 250 rotates so that cylindrical member 210 and pressure roller 230 rotate to draw the leading cut end of photoreceptor belt 100 into the space between the outer surface of the hollow body of cylindrical member 210 and an inner sidewall of filter housing 200. At this time, transfer unit 140 and drying unit 160 are separated from the photoreceptor belt 100 so as to reduce a load applied to squeegee roller 153 and squeegee backup roller 154 which squeegees the photoreceptor belt 100.

When the leading cut end 101 of photoreceptor belt 100 is guided into filter housing 200, photoreceptor belt 100 may not be well wound around the outer surface of the hollow body of cylindrical member 210. In other words, since filter housing 200 is entirely detached from the printer, it is enough that photoreceptor belt 100 extracted from belt unit 50 is stacked between the outer surface of the hollow body of cylindrical member 210 and the inner sidewall of filter housing 200. A gap or a space between the outer surface of the hollow body of cylindrical member 210 and the inner sidewall of filter housing 200 is large enough to accommodate photoreceptor belt 100 cut by cutting blade 330. After the insertion of the photoreceptor belt 100 into inside of filter housing 200 has been completed, filter housing 200 is detached from the printer along rail 201*a*. The cut photoreceptor belt 100 captured in filter housing 200 is removed, and filter housing 200 accommodating a new filter cartridge 220 is reinstalled in the printer. Therefore, in a process of removing a used photoreceptor belt 100 from belt unit 50, the used photoreceptor belt 100 is cut by cutting blade 330 and drawn into filter housing 200, and filter housing 200 containing the used photoreceptor belt 100 is detached from the printer. The used photoreceptor belt 100 and filter cartridge 220 is removed from filter housing 200, and then filter housing accommodating a new filter cartridge 220 is installed in the printer such that a new photoreceptor belt 100 and a new filter cartridge 200 can replace the used ones at the same time.

As described above, in the apparatus and method of removing a used photoreceptor belt for an electrophotographic printer according to the present invention, a cutting unit having a cutting blade is disposed on a portion of the photoreceptor belt circulating in a traveling track within a belt unit. A filter housing disposed adjacent to both the portion of the photoreceptor belt and the cutting unit includes a cylindrical member rotatably connected to the filter housing, a filter cartridge fixed to the filter housing and inserted into the inside of the cylindrical member, and a gap between the outer surface of the cylindrical member and the filter housing. The used photoreceptor belt cut by a cutting blade is automatically drawn into the filter housing so that the photoreceptor removing process can be conveniently and quickly carried out. Also, the filter cartridge accommodated in the filter housing can be removed together with the photoreceptor belt contained in the filter housing when the filter housing is detached from the printer, thereby the used photoreceptor belt and the used filter cartridge being removed at the same time.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus in a printer, comprising:

a belt unit having a photoreceptor belt traveling in a predetermined circular track within said belt unit between pairs of rotating rollers;

a belt cutting unit disposed adjacent to said belt unit, fixed to said printer;

a cutting blade movably installed in said belt cutting unit, said cutting blade cutting said photoreceptor belt in a transverse direction of said predetermined track when said photoreceptor belt is stationary; and a filter housing disposed adjacent to said belt cutting unit, to wind up in a spool said photoreceptor belt cut by said cutting blade, when said photoreceptor belt is cut.

2. The apparatus of claim 1, further comprised of a cylindrical member rotatably installed within said filter housing, drawing one end of said photoreceptor belt cut by said cutting blade onto said filter housing.

3. The apparatus of claim 2, further comprised of a gap formed between said filter housing and said cylindrical member, accommodating said photoreceptor belt cut by said cutting blade.

4. The apparatus of claim 2, further comprised of a filter cartridge disposed in the inside of said cylindrical member, fixed to said filter housing, filled with a filtering material, filtering foreign materials contained in the air within the printer.

5. The apparatus of claim 2, further comprised of a pressure roller disposed to contract said cylindrical member and rotate by the rotation of said cylindrical member, drawing one end of said photoreceptor belt cut by said cutting blade into said filter housing.

6. The apparatus of claim 5, further comprised of a motor connected to said cylindrical member, rotating said cylindrical member so that said cylindrical member and said pressure roller draw said end of said photoreceptor belt cut by said cutting blade into said filter housing.

7. The apparatus of claim 1, further comprised of a guide member positioned between said belt unit and said filter housing, guiding one end of photoreceptor belt cut by said cutting blade into an opening of said filter housing.

8. The apparatus of claim 1, further comprised of:

a binding rail fixed to said filter housing; and a base fixed to said printer, having a groove accommodating the insertion of the said binding rail, allowing said binding rail to slidably move along said groove.

9. The apparatus of claim 1, further comprised of:

a driver and a lead screw connected to said driver; and a moving block connected to said lead screw, moving linearly during rotation of said lead screw and said driver, said cutting blade mounted on said moving block moving linearly while said driver and said lead screw rotate.

10. The apparatus of claim 1, further comprised of a plurality of rollers rotatably mounted on said belt unit, feeding said photoreceptor belt into said filter housing after said photoreceptor belt has been cut by said cutting blade.

11. An apparatus in a printer, comprising:

a belt unit having a photoreceptor belt circulating in a given track within said belt unit;

a belt cutting unit disposed adjacent to said belt unit, fixed to said printer;

a cutting blade movably installed in said belt cutting unit, cutting said photoreceptor belt of said belt unit during passing through said photoreceptor belt in a transverse direction of said predetermined track; and a filter housing disposed adjacent to said belt unit and said belt cutting unit, to wind up in a spool said photoreceptor belt cut by said cutting blade.

12. The apparatus of claim 11, further comprised of a filter cartridge inserted into the inside of said filter housing, fixed to said filter housing, filled with a filtering material, filtering foreign materials from the air within the printer.

13. The apparatus of claim 11, further comprised of a cylindrical member rotatably installed within said filter housing, introducing one end of said photoreceptor belt cut by said cutting blade into said filter housing said filter housing through an opening formed on said filter housing.

14. The apparatus of claim 13, further comprised of a pressure roller disposed to contract said cylindrical member and rotate by the rotation of said cylindrical member.

15. The apparatus of claim 13, further comprised of:

a motor; and said cylindrical connected to said motor, rotating by said motor so that said photoreceptor belt cut by said cutting blade is introduced into filter housing by the rotation of said cylindrical member and said pressure roller.

16. The apparatus of claim 11, further comprised of:

a driver and a lead screw connected to said driver; and a moving block connected to said lead screw, moving linearly during rotation of said lead screw and said driver, said cutting blade mounted on said moving block moving linearly.

17. The apparatus of claim 11, further comprised of a plurality of rollers rotatably mounted on said belt unit, feeding said photoreceptor belt into said filter housing after said photoreceptor belt has been cut by said cutting blade.

18. A method in a printer having a photoreceptor belt traveling a predetermined track, comprising of the steps of:

providing a cutting blade disposed adjacent to said photoreceptor belt;

allowing said cutting blade to pass through said photoreceptor belt in a traverse direction of said predetermined track, thereby cutting said photoreceptor belt;

providing a filter housing disposed adjacent to said photoreceptor belt; and allowing said filter housing to wrap up in a spool said photoreceptor belt cut by said cutting blade.

19. The method of claim 18, further comprised of the step of:

providing a plurality of rollers disposed on said predetermined track; and rotating said roller to introduce said photoreceptor belt into said filter housing after said photoreceptor belt has been cut by said cutting blade.

20. The method of claim 18, further comprised of the step of:

providing a cylindrical member rotatably installed in said filter housing; and allowing said cylindrical member to rotate such that one end of said photoreceptor belt cut by said cutting blade is fed into said filter housing.

21. The method of claim 18, further comprised of the step of:

providing a binding rail attached to said filter housing;

providing a base fixed to said printer and having a groove accommodating the slidable insertion of said binding rail; and allowing said binding rail to slide out said groove so that the filter housing is detached from said printer.

* * * * *